US008196371B2

(12) United States Patent
Yuyama

(10) Patent No.: US 8,196,371 B2
(45) Date of Patent: Jun. 12, 2012

(54) CAP SUPPLY DEVICE

(75) Inventor: Shoji Yuyama, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 419 days.

(21) Appl. No.: 12/300,457

(22) PCT Filed: Apr. 26, 2007

(86) PCT No.: PCT/JP2007/059081

§ 371 (c)(1),
(2), (4) Date: Nov. 11, 2008

(87) PCT Pub. No.: WO2007/132665

PCT Pub. Date: Nov. 22, 2007

(65) Prior Publication Data

US 2009/0241470 A1 Oct. 1, 2009

(30) Foreign Application Priority Data

May 11, 2006 (JP) ..... 2006-132493

(51) Int. Cl.
*B67B 3/06* (2006.01)

(52) U.S. Cl. ..... 53/306; 53/287; 53/324; 198/396

(58) Field of Classification Search ..... 53/285, 53/287, 306, 319, 322, 324, 367; 198/393, 198/396

See application file for complete search history.

(56) References Cited

U.S. PATENT DOCUMENTS

| | | | | | |
|---|---|---|---|---|---|
| 1,651,902 | A | * | 12/1927 | Pennock | 53/304 |
| 2,154,266 | A | * | 4/1939 | Ferd | 53/440 |
| 2,352,761 | A | * | 7/1944 | Bell | 53/109 |
| 2,732,114 | A | * | 1/1956 | Annen | 53/306 |
| 3,382,646 | A | * | 5/1968 | Leudtke et al. | 53/314 |
| 3,623,594 | A | * | 11/1971 | Ravn et al. | 198/396 |
| 3,626,658 | A | * | 12/1971 | Jones | 53/67 |
| 3,629,989 | A | * | 12/1971 | Reinecke | 53/64 |
| 3,780,493 | A | * | 12/1973 | Baker | 53/287 |
| 3,970,218 | A | * | 7/1976 | Lee | 221/157 |
| 4,065,909 | A | * | 1/1978 | Mueller | 53/420 |

(Continued)

FOREIGN PATENT DOCUMENTS

JP 49-4366 1/1974

(Continued)

OTHER PUBLICATIONS

PCT International Search Report for PCT/JP2007/059081, in English and Japanese, 5 pages (mailed Jun. 12, 2007).

(Continued)

*Primary Examiner* — Paul R Durand
(74) *Attorney, Agent, or Firm* — Jones Day; Christopher C. Bolten

(57) ABSTRACT

The present invention is directed to a cap supply device having a simple and inexpensive structure and which is capable of supplying caps all directed in the same direction. The cap supply device includes: a receiving section 104 for receiving the caps 3; and a discharge unit 106 having an endless member 108 placed in the receiving section 104 and support members 109 provided at the endless member. The discharge unit 106 is configured to lift the caps upward and discharge the caps 3 from the receiving section 104 while the caps 3 are supported at the support members 109 with their openings directed to an opposite side of the endless member 108.

18 Claims, 16 Drawing Sheets

U.S. PATENT DOCUMENTS

| | | | | | |
|---|---|---|---|---|---|
| 4,222,214 | A | * | 9/1980 | Schultz et al. | 53/309 |
| 4,696,144 | A | * | 9/1987 | Bankuty et al. | 53/331.5 |
| 4,735,343 | A | * | 4/1988 | Herzog | 221/159 |
| 4,995,781 | A | * | 2/1991 | Herzog | 414/680 |
| 5,115,617 | A | * | 5/1992 | Lewis et al. | 53/306 |
| 5,159,797 | A | * | 11/1992 | Herzog | 53/312 |
| 5,208,762 | A | | 5/1993 | Charhut et al. | |
| 5,309,696 | A | * | 5/1994 | Heudecker et al. | 53/306 |
| 5,333,718 | A | * | 8/1994 | Pannell et al. | 198/397.06 |
| 5,394,972 | A | | 3/1995 | Aidlin et al. | |
| 5,437,361 | A | * | 8/1995 | Ohmori et al. | 198/465.1 |
| 5,502,944 | A | | 4/1996 | Kraft et al. | |
| 5,531,057 | A | * | 7/1996 | Coleman et al. | 53/308 |
| 5,586,637 | A | * | 12/1996 | Aidlin et al. | 198/397.06 |
| 6,341,472 | B1 | * | 1/2002 | Schroeder | 53/426 |
| 6,430,896 | B1 | * | 8/2002 | Torikian | 53/310 |
| 2009/0166153 | A1 | * | 7/2009 | Dotson et al. | 198/393 |

FOREIGN PATENT DOCUMENTS

| | | | |
|---|---|---|---|
| JP | 57-194981 | | 11/1982 |
| JP | 63-116410 | | 7/1988 |
| JP | 4-101927 | | 3/1992 |
| JP | 4-39206 | | 9/1992 |
| JP | 7-251915 | | 10/1995 |
| JP | 2002-179004 | | 6/2002 |
| JP | 2005-211519 | | 8/2005 |
| JP | 2006-240738 | | 9/2006 |
| WO | WO 2005/073123 | A1 | 8/2005 |
| WO | WO 2006/082969 | A1 | 8/2006 |

OTHER PUBLICATIONS

PCT Written Opinion of the International Searching Authority for PCT/JP2007/059081, in Japanese, 5 pages (mailed Jun. 12, 2007).

* cited by examiner

CAP SUPPLY DEVICE

CROSS-REFERENCE TO RELATED APPLICATIONS

This application is a 35 U.S.C. §371 U.S. National Stage filing of International Application No. PCT/JP2007/059081, filed under the Patent Cooperation Treaty on Apr. 26, 2007, and claims priority under 35 U.S.C. §119 to Japanese Patent Application No. 2006-132493, filed May 11, 2006, both of which are incorporated herein by reference in their entireties.

TECHNICAL FIELD

The present invention relates to a cap supply device for filling tablets in vials as prescribed.

BACKGROUND ART

Conventionally, vials are closed using caps after receiving tablets {see U.S. Pat. No. 5,502,944 ("Patent Document 1") and U.S. Pat. No. 5,208,762 ("Patent Document 2")}.

Patent Document 2 discloses a device for supplying caps to a capping device, which closes vials through using the caps. Such a device can supply the caps one by one by applying vibrations using a vibrator. It can also change the direction of the caps so that they are all placed in the same direction by using a posture control means. Also, Japanese Laid-Open Patent Publication No. (Hei) 7-251915 ("Patent Document 3") discloses a device for supplying caps to a capping device, which can close vials by using the caps. Such a device adopts a step shape formed at an outer periphery of a center wheel by rotating a scratch circular plate, which is installed with an inclination.

SUMMARY OF THE INVENTION

However, Patent Document 1 does not disclose a structure for automatically supplying the caps to the vials. Further, Patent Document 2 does not disclose any specific structures resulting therefrom. Moreover, according to Patent Document 3, the vibrator and the posture control means are essential for the cap supply section. Clearly, this increases the costs and complicates the structure. Also, Japanese Laid-Open Patent Publication No. 2002-179004 ("Patent Document 4") discloses that an area for receiving the caps is limited in order to properly perform the direction change of the caps by using the center wheel.

Thus, it is an object of the present invention to provide a cap supply device having a simple and inexpensive structure and which is capable of supplying caps all placed in the same direction.

In order to solve the above problems, the present invention relates to a cap supply device for receiving caps used for closing vials filled with tablets and supplying the caps to a capping section one at a time. The cap supply device comprises: a receiving section for receiving the caps; and a discharge unit having an endless member located within the receiving section in a vertically circulating manner and support members provided at the endless member at regular intervals, wherein the discharge unit can upwardly lift and discharge the caps from the receiving section while the caps are vertically supported in the support members with openings of the caps being directed to an opposite side of the endless member.

Specifically, the caps with openings directed to the endless member are detached from the support members, whereas the caps with openings directed to the opposite side of the endless member are supported at the support member and lifted upward and then discharged from the receiving section. This is because the center of gravity of the caps held in a vertical direction resides not in the center of thickness of the caps but rather in an opposite side of the openings (i.e., closed side). Thus, it is possible to supply the caps in the same direction.

The endless member of the discharge unit preferably includes a vertical portion and a tilt portion that is inclined downward from a lower end of the vertical portion. By doing so, the caps received in the receiving section are conveyed to the vertical portion while being loaded on the tilt portion. Only the caps with the openings directed to the opposite side of the endless member in the tilt portion are supported at the support members and then discharged.

It is preferable to provide a stirring member at a side wall of the receiving section. The stirring member is capable of reciprocating in a vertical direction along the side wall. By doing so, since the caps received in the receiving section are stirred to thereby change the postures of the caps, the caps are easily supported at the support members of the endless member.

The stirring member is formed from a plate, which is parallel to the side wall of the receiving section. The plate is preferably provided with a hanging section where the caps are hung. By doing so, since the caps received in the receiving section are hung in the hanging section, the stirring is enhanced. Thus, since the postures of the caps can be easily changed, the caps are more easily supported at the support members of the endless member.

The hanging section is a hole that is elongated along a vertical direction. It is preferable that a plurality of the holes is formed in a vertical direction at regular intervals. By doing so, the hanging section can be formed with a simple structure without reducing the capacity of the receiving section.

It is preferable that the stirring member is driven to interlock with the endless member. By doing so, since one power source is sufficient, an arrangement structure can be simplified.

Further, it is preferable that a discharge path, which is extended in a vertical direction parallel to the endless member, is formed in a re-bent side of the endless member. Also, a guide plate for guiding the cap, which is to be returned in an upper end of the endless member, to the discharge path is provided at an upper end of the guide path. By doing so, since it is possible to make the endless member and the discharge path as close as possible, the device can become compact.

It is preferable that a plurality of the cap supply devices are provided such that the caps of different types are discharged from each cap supply device having a cap selecting unit for selecting and supplying any one of the caps discharged from each cap supply device. By doing so, it is possible to simply select the caps of different sizes and discharge them to a supplier.

Moreover, it is preferable that the cap selecting unit has a cap receiving section capable of receiving the caps. Further, a plurality of rotary members can be provided in each of the cap supply devices. The rotary members can be rotated between a receiving position where the cap receiving section is directed opposite to a discharging direction of the caps discharged from each cap supply device and a supplying position where the cap receiving section is directed to a supplying direction of the caps. The cap selecting unit preferably selects any one of the caps discharged from each cap supply device by selectively rotating the rotary members and supplies the caps. By doing so, since a space occupied by the cap selecting unit can be decreased, it is possible to make the device compact.

According to the present invention, only the caps with the openings directed to the opposite side of the endless member are supported at the support members, lifted upward by the endless member and then discharged. Thus, it is possible to supply the caps in the same direction using the inexpensive and simplified structure.

BRIEF DESCRIPTION OF THE DRAWINGS

In the following, for the present invention to be understood, an embodiment of the present invention is described with reference to the accompanying drawings. The following embodiment is only given by way of example, and does not restrict the technical scope of the present invention.

Figure 1:
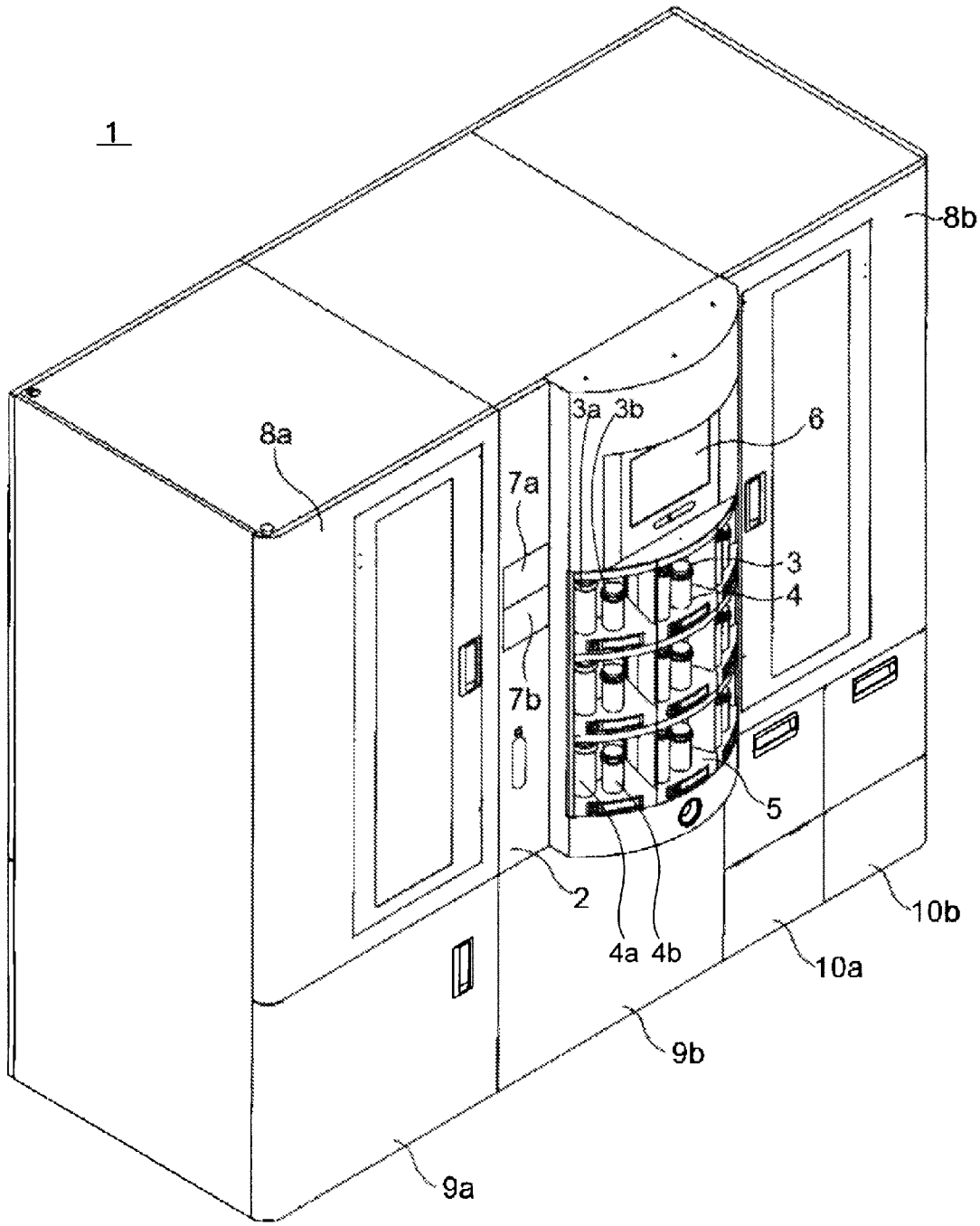
FIG. 1 is a perspective view of a tablet filling device according to the present invention.

In the drawings, the following reference symbols are used:

3 . . . cap,
19 . . . cap supply unit,
20 . . . capping unit,
104 . . . receiving section,
105 . . . discharge unit,
106 . . . stirring unit,
108 . . . endless belt,
108*a* . . . vertical portion,
108*b* . . . tilt portion,
109 . . . support members,
115 . . . discharge path,
116 . . . guide plate,
118 . . . stirring plate,
118*a* . . . hanging holes,
122 . . . cap selecting unit,
124 . . . rotor,
129 . . . large cap receiving section,
130 . . . small cap receiving section,
136 . . . large cap receiving section, and
137 . . . small cap receiving section.

DETAILED DESCRIPTION

Hereinafter, embodiments of the present invention will be explained with reference to the accompanying drawings.

FIG. 1 shows an exterior of a tablet filling device 1 according to an embodiment of the present invention. Nine extracting shelves 5 are placed at a center door 2, which is provided at a front center of the tablet filling device 1. Vials 4 filled with tablets and closed by a cap 3 are stacked from an inner side in the extracting shelves 5. The extracting shelves 5 are protruded forward and bent so as to easily extract the vials 4. An operation display screen 6 for displaying the required information by operating the tablet filling device 1 is provided at an upper direction of the extracting shelves 5. Cap inlets 7*a* and 7*b* for inputting large and small caps 3*a* and 3*b* are formed at a left side of the extracting shelf 5. Right and left doors 8*a* and 8*b*, which are opened and closed when attaching and detaching a tablet cassette 21 (not shown in FIG. 1), are provided at both sides of the center door 2. A door 9*a* for checking an inner device is provided at a lower direction of the left side door 8*a*. A closet 9*b* for checking the inner device is provided at a lower direction of the center door 2. Two doors 10*a* and 10*b* for inputting the large and small vials 4*a* and 4*b* are provided at a lower direction of the right side door 8*b*.

Figure 2:
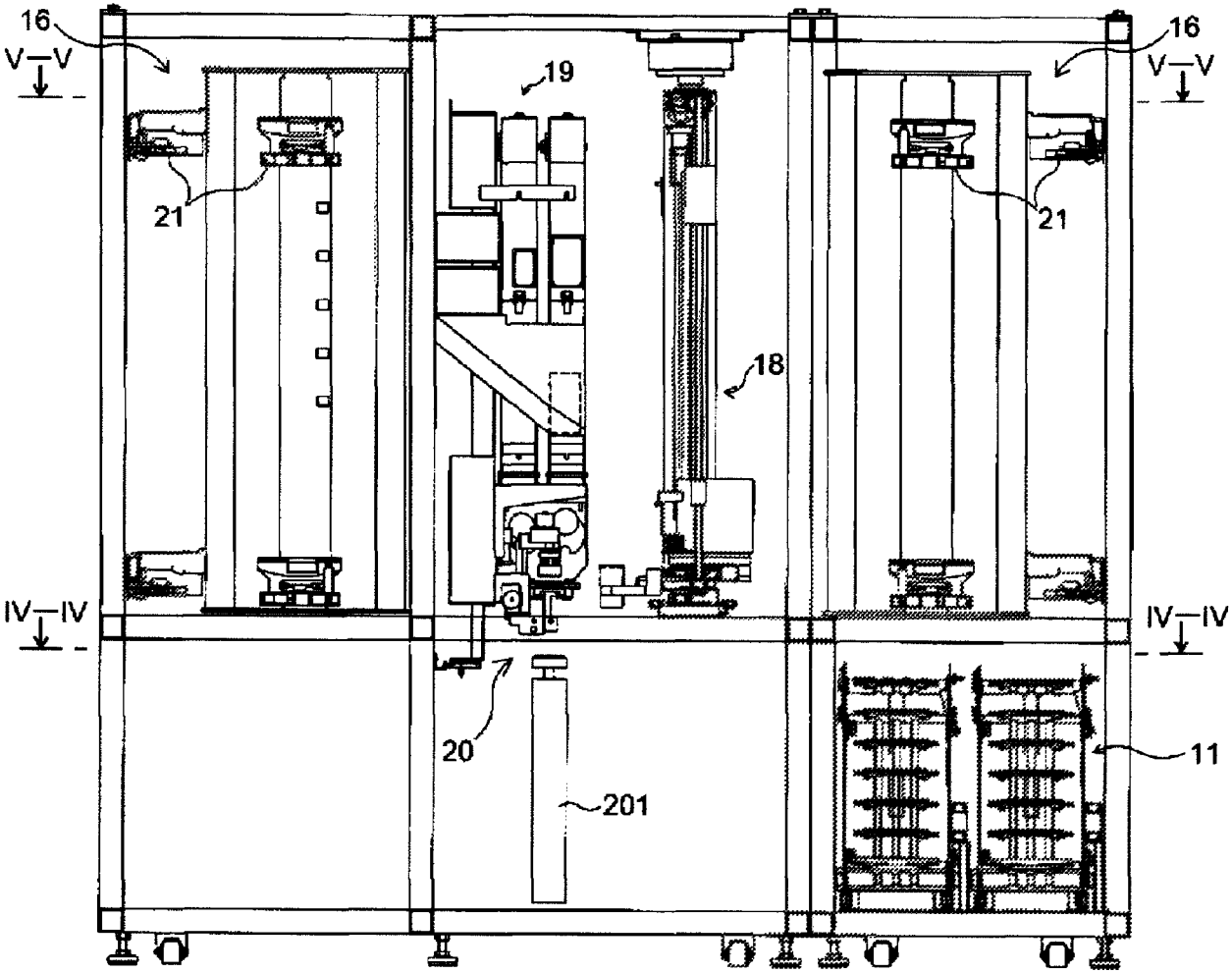
FIG. 2 is a front view illustrating the removal of a door of the tablet filling device.
Figure 3:
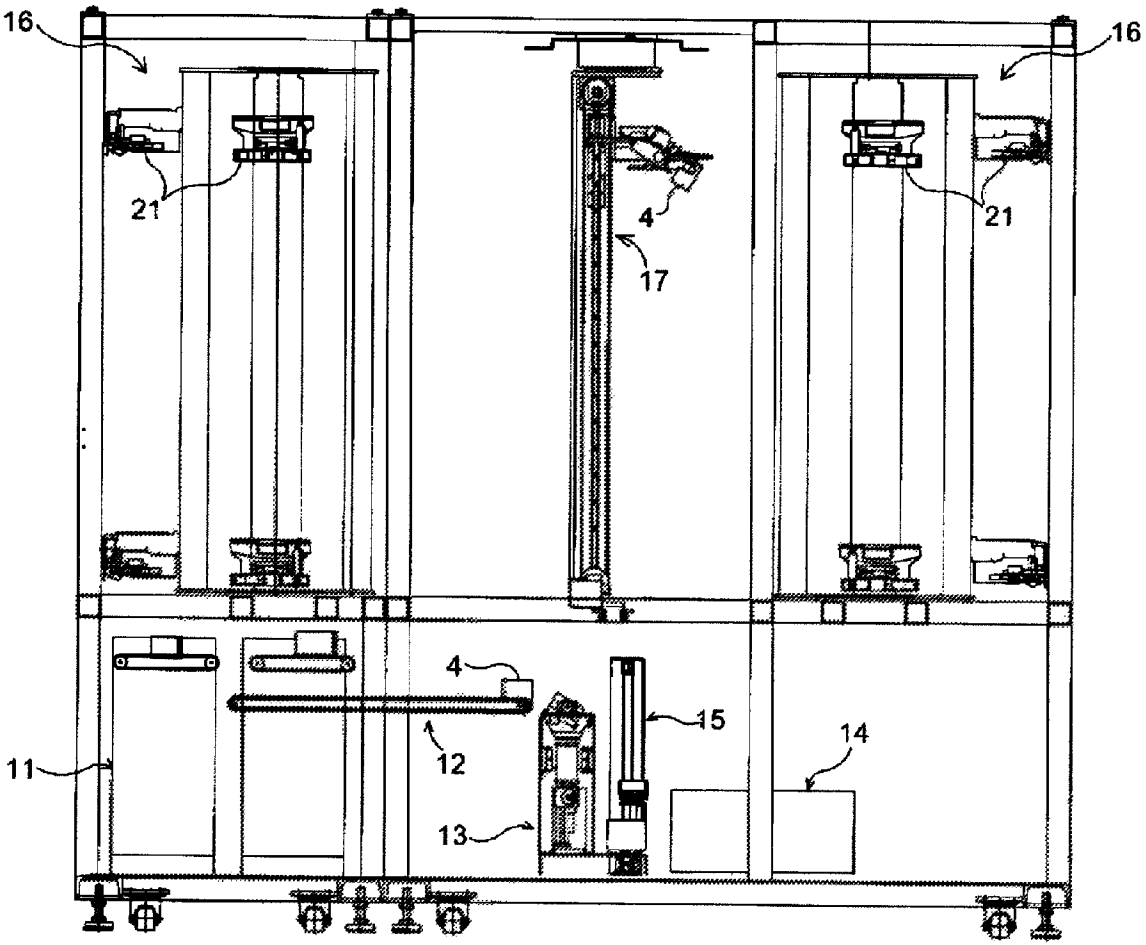
FIG. 3 is a rear view illustrating the removal of an exterior plate of the tablet filling device.
Figure 4:
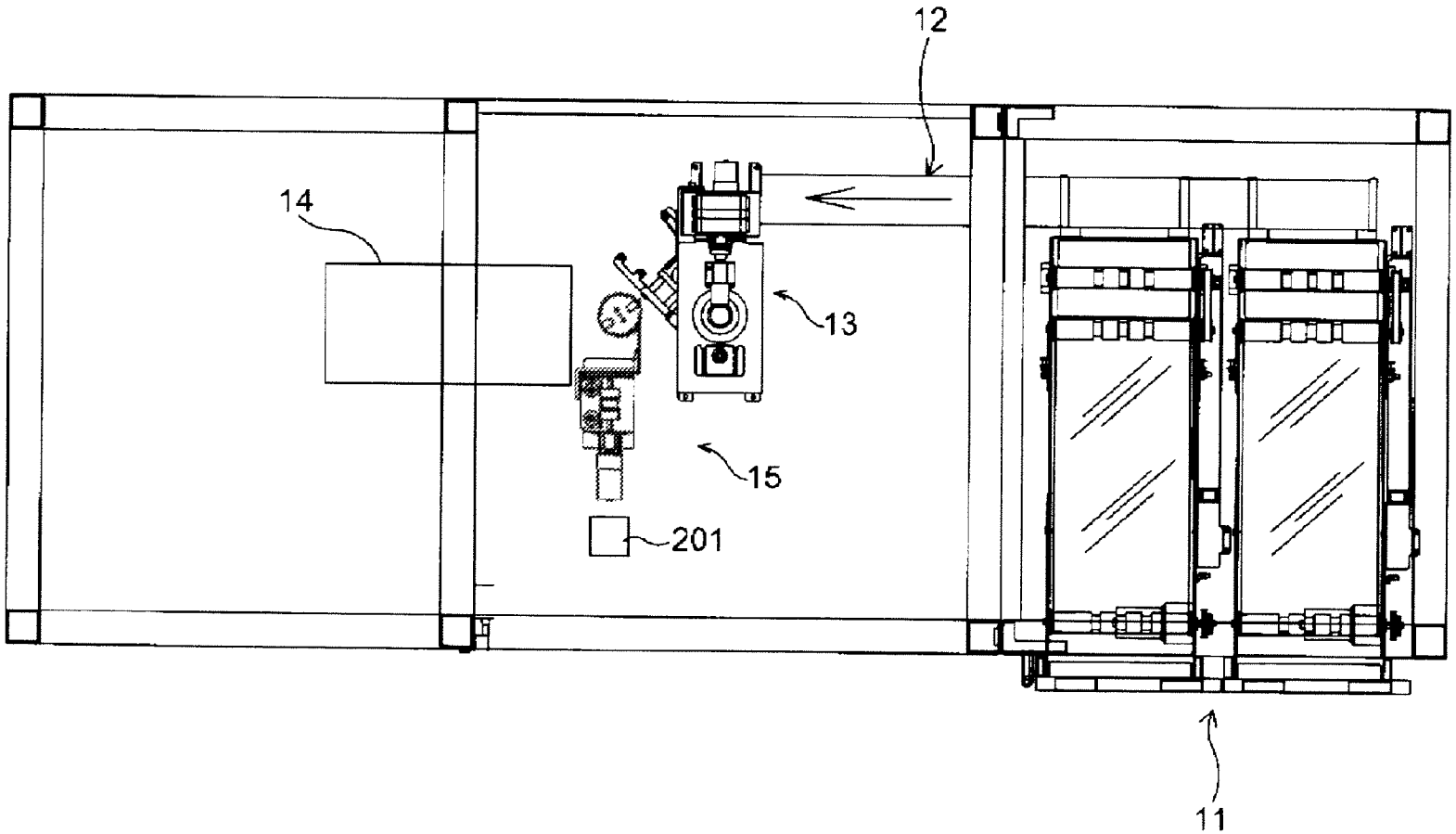
FIG. 4 is a cross-sectional view taken along the line IV-IV of FIG. 2.
Figure 5:
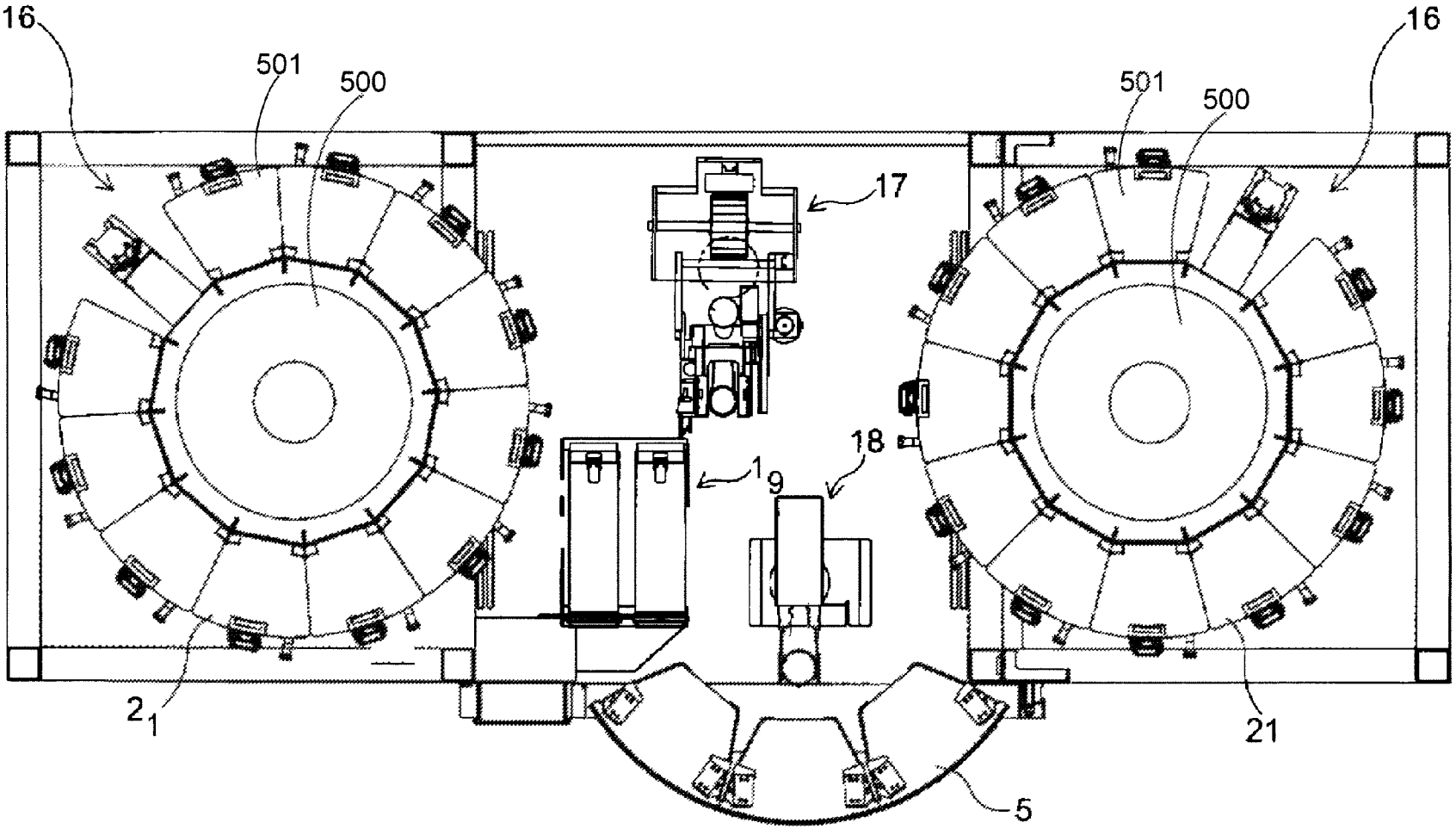
FIG. 5 is a cross-sectional view taken along the line V-V of FIG. 2.

FIG. 2 is a front view illustrating the removal of the door of the tablet filling device. FIG. 3 is a rear view illustrating the removal of an exterior plate of the tablet filling device. FIG. 4 is a cross-sectional view taken along the line IV-IV of FIG. 2. FIG. 5 is a cross-sectional view taken along the line V-V of FIG. 2. As shown in the above figures, the tablet filling device 1 comprises two vial supply units 11, a vial conveyance belt 12, a vial conveyance arm unit 13, a labeling unit 14, a vial lift unit 15, two tablet supply units 16, a first vial delivery arm unit 17, a second vial delivery arm unit 18, a cap supply unit 19 and a capping unit 20.

Two vial supply units 11 are provided at a right lower portion (when viewed from the front). The vial supply units 11 store the large and small vials 4, and extract and supply the vials 4 required for receiving the tablets according to prescription.

The vial conveyance belt 12 is provided at a rear of the vial supply unit 11 and horizontally extended toward the center, thereby conveying the vials 4 supplied from the vial supply unit 11 to the vial conveyance arm unit 13.

The vial conveyance arm unit 13 is positioned at an end section of the vial conveyance belt 12 and changes the direction of the vials 4 conveyed from the vial conveyance belt 12 so as to be opened upward. Thereafter, it conveys the vials 4 to the labeling unit 14 and the vial lift unit 15.

The labeling unit 14 is positioned at a left lower portion (when viewed from the front) and attaches a label to the vials 4 conveyed from the vial conveyance arm unit 13.

The vial lift unit 15 is positioned between the labeling unit 14 and the vial conveyance arm unit 13. The vial lift unit 15 lifts the vials 4 labeled by the labeling unit 14, thereby guiding them to the first vial delivery arm unit 17.

The tablet supply units 16 are positioned at right and left sides (when viewed from the front). Each tablet supply unit 16 has a plurality of tablet feeders 501 provided around a rotatable drum 500 and discharges the tablets according to prescriptions from the tablet feeder, thereby supplying the tablets to the vials 4 held in the first vial delivery arm unit.

The first vial delivery arm unit 17 is positioned at a rear side and between the two tablet supply units 16. The first vial delivery arm unit 17 receives the vials 4 from the vial lift unit 15 and moves to any tablet feeder 501 of the tablet supply unit 16. It then guides the vials 4 to the second vial delivery arm unit 18 when the tablets according to the prescriptions are filled.

The second vial delivery arm unit 18 is positioned at a front side and between the two tablet supply units 16. The second vial delivery arm unit 18 guides the vials 4 received from the first vial delivery arm unit 17 to the capping unit 19, thereby capping the vials 4 and stacking the capped vials 4 on one of the extracting shelves 5.

The cap supply unit 19 is positioned at a left side (when viewed from the front) of the second vial delivery arm unit 18. The cap supply unit 19 receives two types of caps 3 (i.e., large and small caps 3) used for closing the vials 4 and supplies any one of the caps 3 one by one.

The capping unit 20 is positioned at a lower direction of the cap supply unit 19 provided with the caps 3 supplied from the cap supply unit 19 to the vials 4 received from the second vial delivery arm unit 18.

Hereinafter, the cap supply unit 19 and the capping unit 20 (i.e., the cap supply device of the present invention) will be explained in detail.

<Cap Supply Unit>

Figure 6:
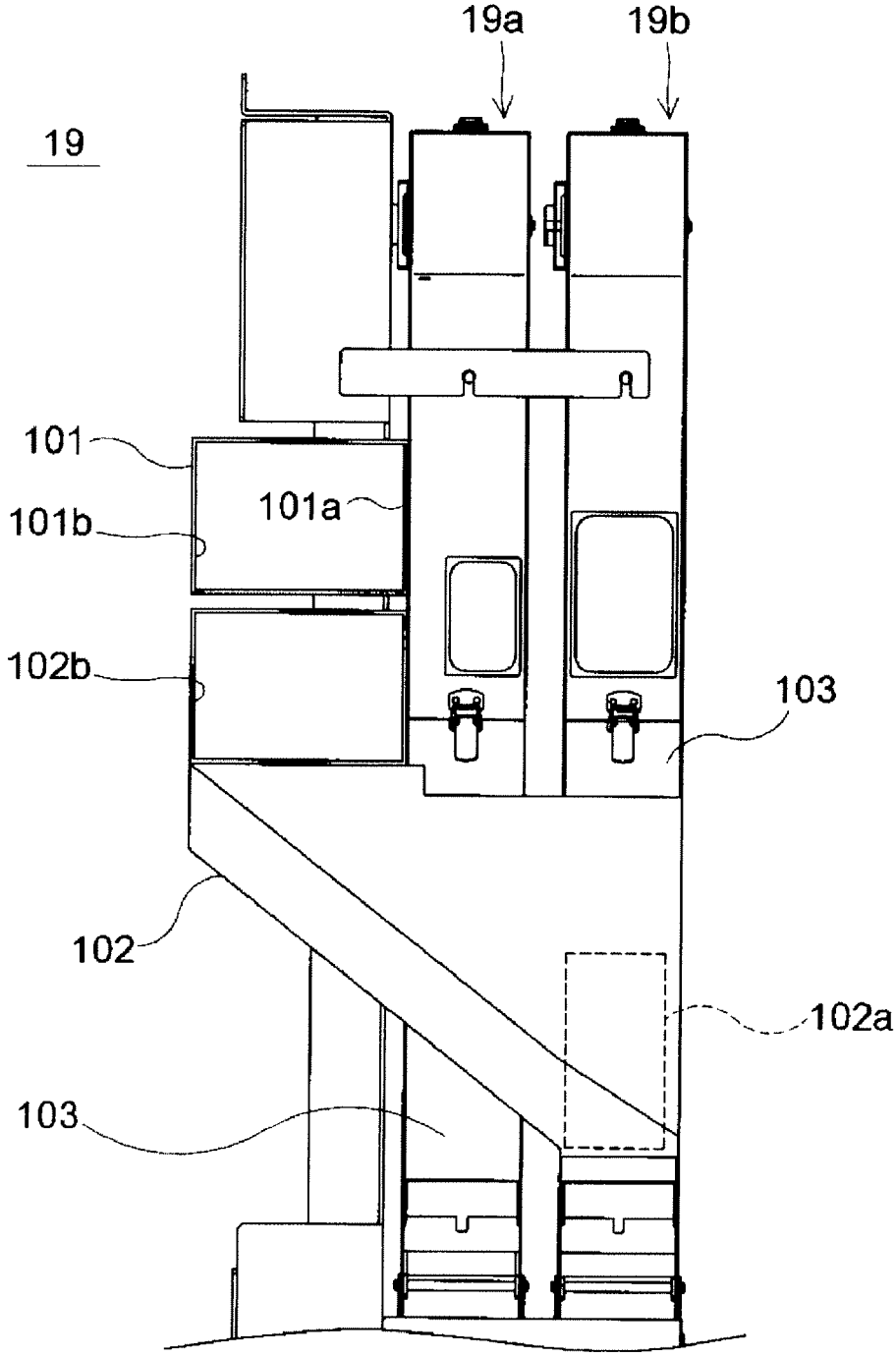
FIG. 6 is a front view of a vial supply unit.
Figure 7:
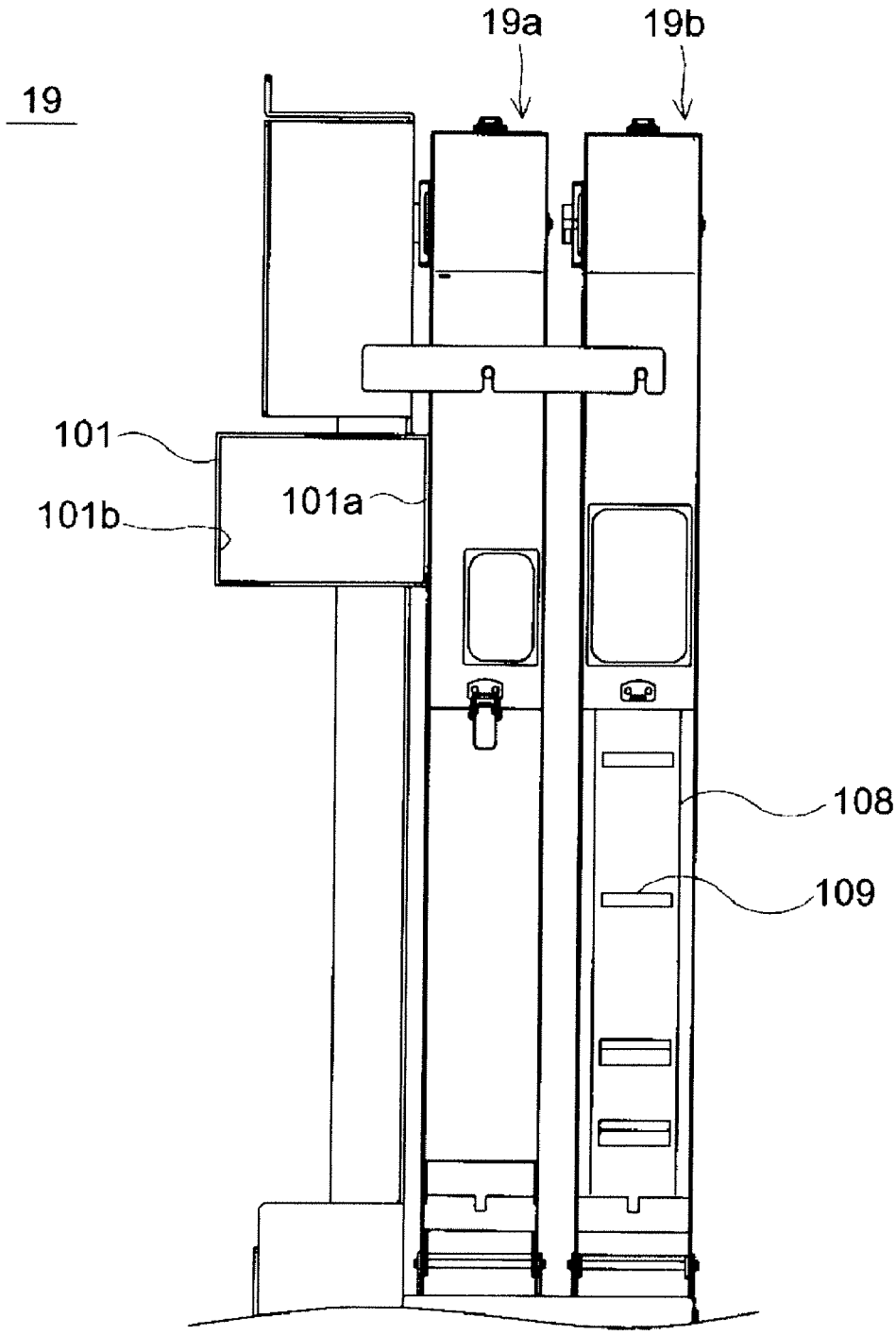
FIG. 7 is a front view illustrating the removal of a cover of the vial supply unit of FIG. 6.

FIG. 6 shows a front exterior of the cap supply unit 19. The cap supply unit 19 is provided with a large cap supply unit 19*a* and a small cap supply unit 19*b*, which are adjacent to each other at right and left sides. A large cap introducing duct 101 is provided at the left side of the large cap supply unit 19*a* in the drawings. The large cap introducing duct 101 is extended from an introducing port 101*a* formed at a left side wall of the big cap supply unit 19*a* to a front side and an opening 101*b* at the front is opposite to a door 2. A small cap introducing duct 102 is provided at a front of the small cap supply unit 19*b*. The small cap introducing duct 102 is integrally formed with a cover 103 of the small cap supply unit 19*b* and extended from an introducing port 102*a* formed in the cover 103 to a left side. It is further extended from the left side of the large cap supply unit 19*a* via the front of the large cap supply unit 19*a* to the front side. Further, an opening 102*b* at the front is opposite to the door 2. FIG. 7 shows a state of removing the small cap introducing duct 102. Since the large cap supply unit 19*a* and the small cap supply unit 19*b* have the same structure except for the cap introducing ducts 101 and 102, they will be explained without being distinguished from each other.

Figure 8:
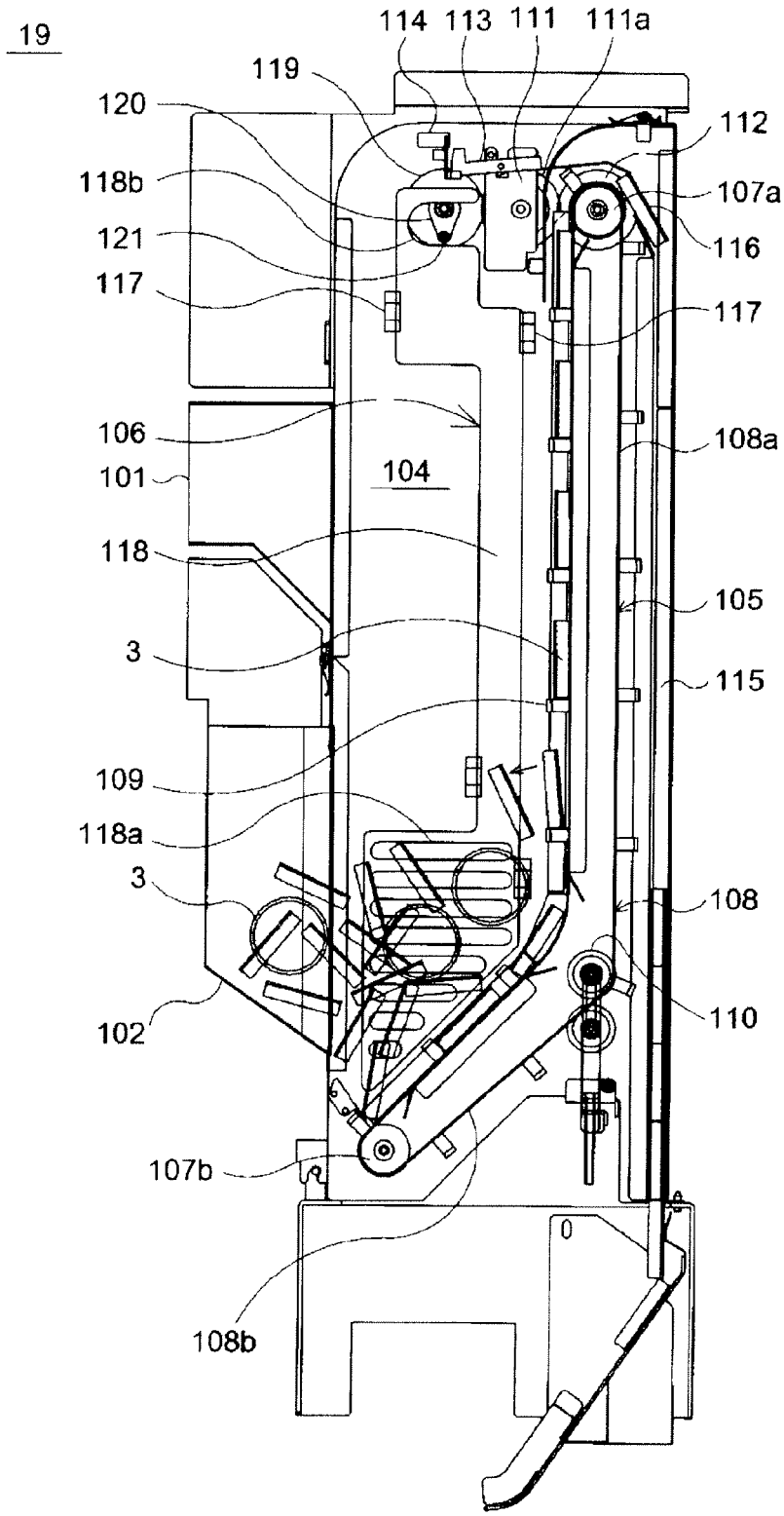
FIG. 8 is a side cross-sectional view of the vial supply unit of FIG. 6.

FIG. 8 is a side view of the cap supply unit 19. The cap supply unit 19 includes a receiving section 104 of the cap, a discharge unit 108, a stirring unit 106 and a cap selecting unit 122.

The receiving section 104 is a container in a rectangular box shape for randomly receiving a large number of the caps 3 inputted via the cap introducing ducts 101 and 102.

Figure 9:
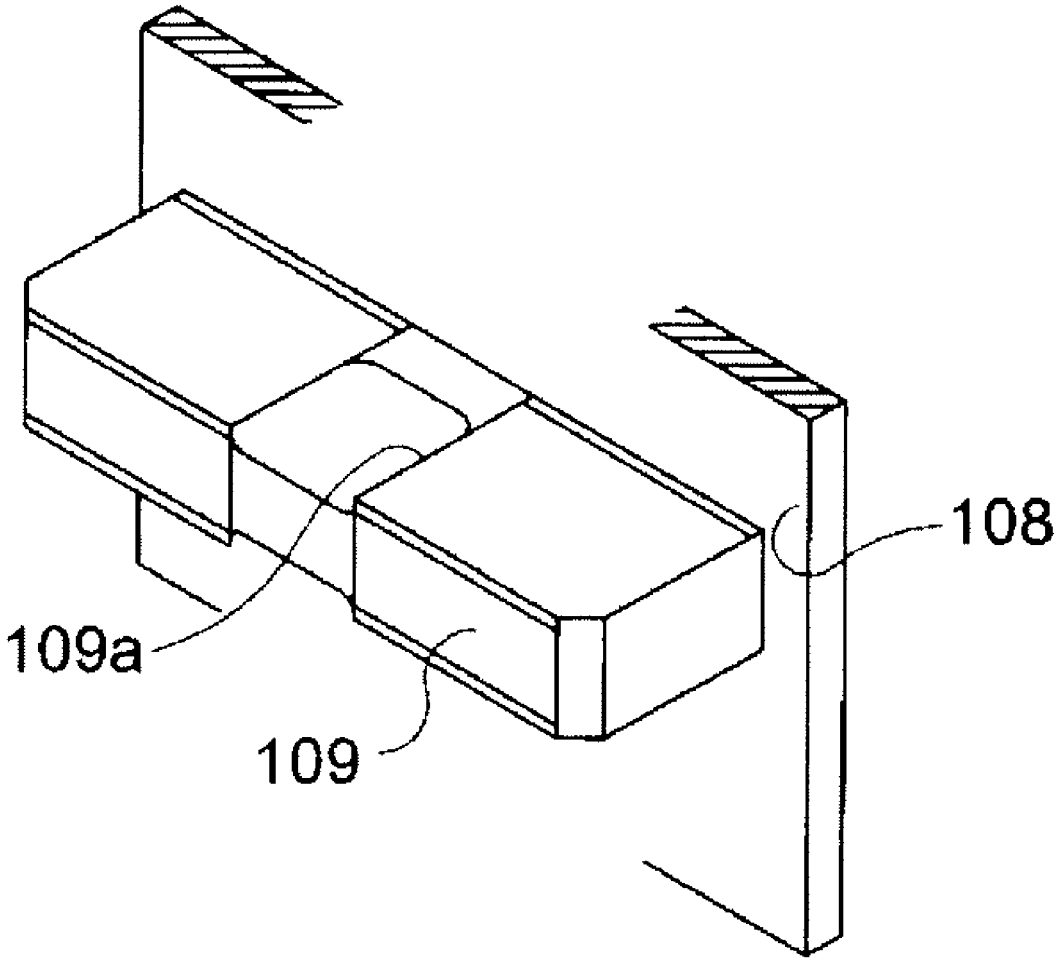
FIG. 9 is an expanded perspective view of a support member of an endless belt.
Figure 10:
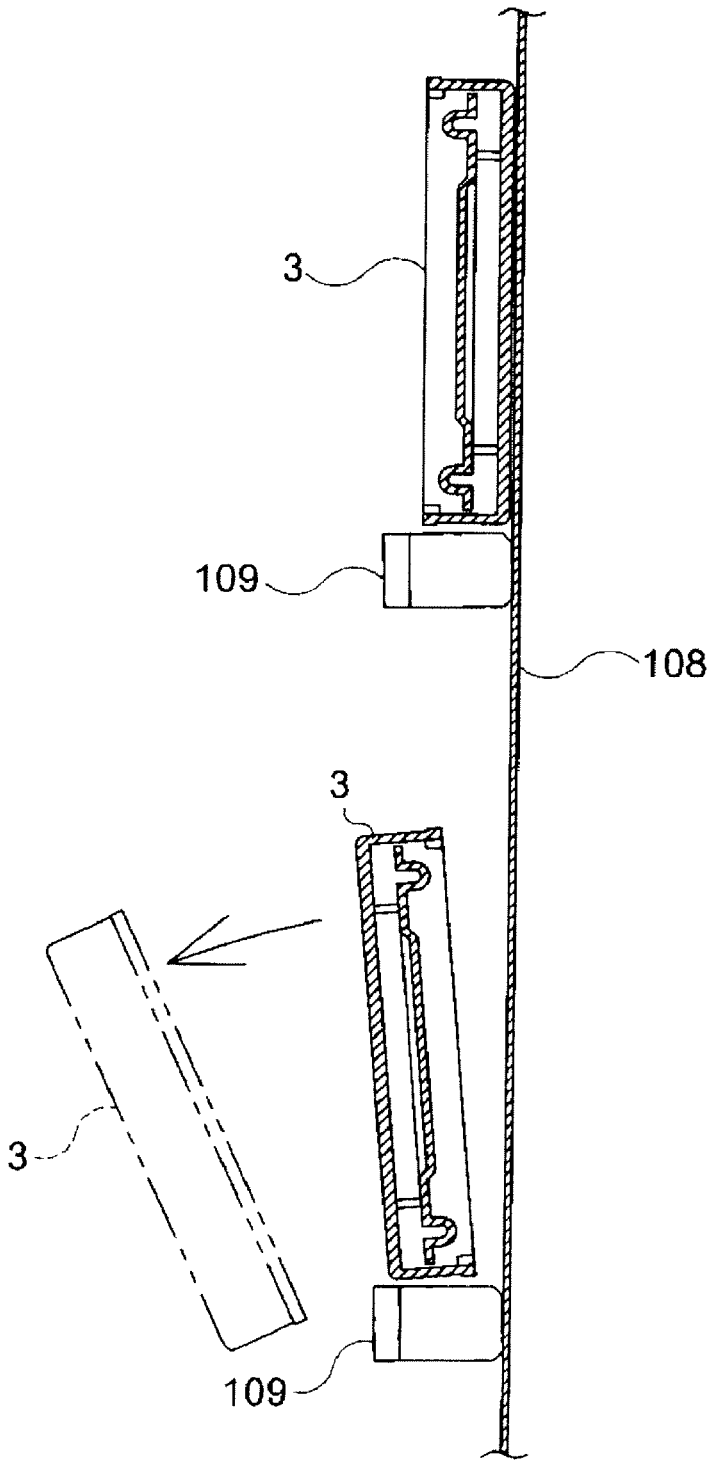
FIG. 10 is a cross-sectional view showing a support state of the cap by the support member of the endless belt.

The discharge unit 105 has an endless belt 108 extended between two rollers 107*a* and 107*b* from a rear side wall of the receiving section 104 to a bottom wall. It is provided with support members 109 at regular intervals. The endless belt 108 includes a vertical portion 108*a* and a tilt portion 108*b* that is inclined downward from a lower end of the vertical portion 108*a*. A tension roller 110 is contacted from an inner side between the vertical portion 108*a* and the tilt portion 108*b* of the endless belt 108 at a rear side. Since the roller 107*a* at an upper side is driven by a motor 111 via gears 111*a* and 112, the endless belt 108 at a surface side is lifted upward with an inclination from a lower end and then lifted in a vertical direction to thereby move as re-bending at an upper end. As shown in FIG. 9, the support member 109 is protruded from the endless belt 108 with a size slightly larger than a thickness of the caps 3. It is provided with a cutout 109*a* at a center portion such that the caps 3 are stably supported. As shown in the upper portion of FIG. 10, the support member 109 can stably support the caps 3 when the openings of the caps 3 are directed to the opposite side of the endless belt 108. Further, as shown in the lower portion of FIG. 10, the caps 3 are detached from the support member 109 when the openings of the caps 3 are opposite to the endless belt 108. This is because the center of gravity of the caps in a vertical direction resides not in the center of the thickness of the caps but rather in the side opposite to the openings (i.e., closed side).

Referring again to FIG. 8, a detecting lever 113 and a sensor 114 are provided around an upper end of the endless belt 108 of the discharge unit 105. The detecting lever 113 is operated when the cap 3 supported at the support member 109 is returned. The sensor 114 is switched on and off according to the operation of the detecting lever 113.

A discharge path 115, which is parallel to the vertical portion 108*a* of the endless belt 108, is formed behind the discharge unit 105. The discharge path 115 is configured to receive the caps 3, which are conveyed by the discharge unit 105 and arrive on the re-bent portion of the upper end, and guide them downward. A guide plate 116 for guiding the caps 3 to the discharge path 115 is provided at the upper end of the discharge path 115.

The stirring unit 106 has a stirring plate 118 capable of reciprocating in a vertical direction by a plurality of guides 117 along an inner wall of the receiving section 104. A plurality of hanging holes 118*a* are formed at a lower portion of the stirring plate 118 at regular intervals. The hanging holes 118*a* are extended in a horizontal direction where the caps 3 received in the receiving section 104 are hung. The hanging holes 118*a* are not limited to the holes but may be protrusions. The hanging holes 118*a* are more preferable since they do not reduce the capacity of the receiving section 104. A cutout 118*b* is formed at a side portion edge of an upper portion of the stirring plate 118. Since a roller 121 at a leading end of a cam 120 integrally formed with a gear 119, which is engaged with a driving gear 111*a* of a motor 111 of the discharge unit 105, is contacted in an edge at an upper side of the cutout 118*b*, the stirring plate 118 is configured to periodically reciprocate in a vertical direction as interlocking with the endless belt 108 of the discharge unit 105.

Figure 11:
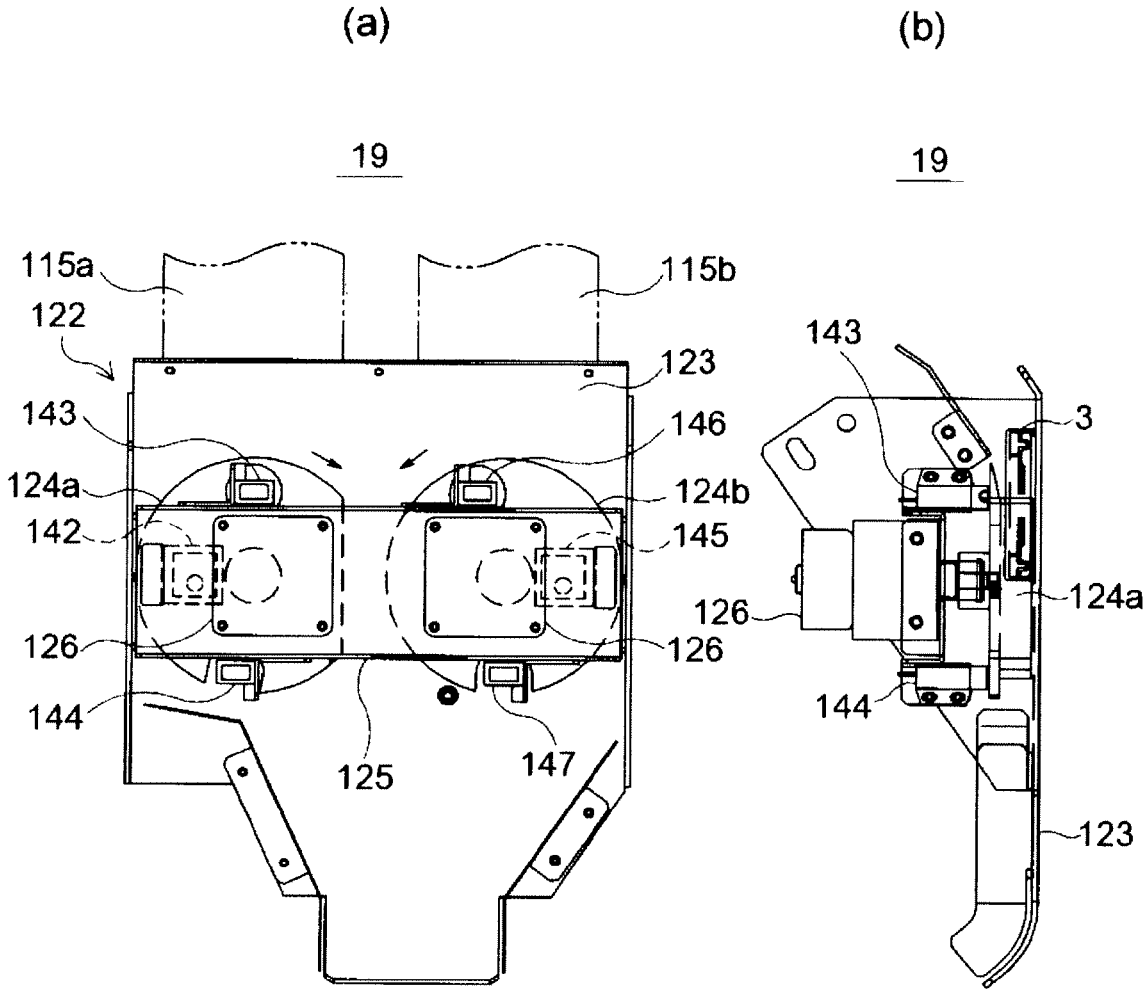
FIG. 11 is a front view (a) and a side view (b) of a cap selecting unit.

As illustrated in FIGS. 11(*a*) and 11(*b*), the cap selecting unit 122 has a chute 123, a large cap rotor 124*a* and a small cap rotor 124*b*.

The chute 123 is installed with an inclination and an upper end of the chute 123 is connected with a discharge path 115*a* of the large cap supply unit 19*a* and a discharge path 115*b* of the small cap supply unit 19*b*, thereby receiving the large cap 3*a* and the small cap 3*b* from both supply units. A lower end of the chute 123 is narrowed by a width through which any one of the large cap 3*a* and small cap 3*b* is passed. A substrate 125 is provided between side walls at both ends of the chute 123 so as to be opposite to the inclined surface of the chute 123.

Figure 12:
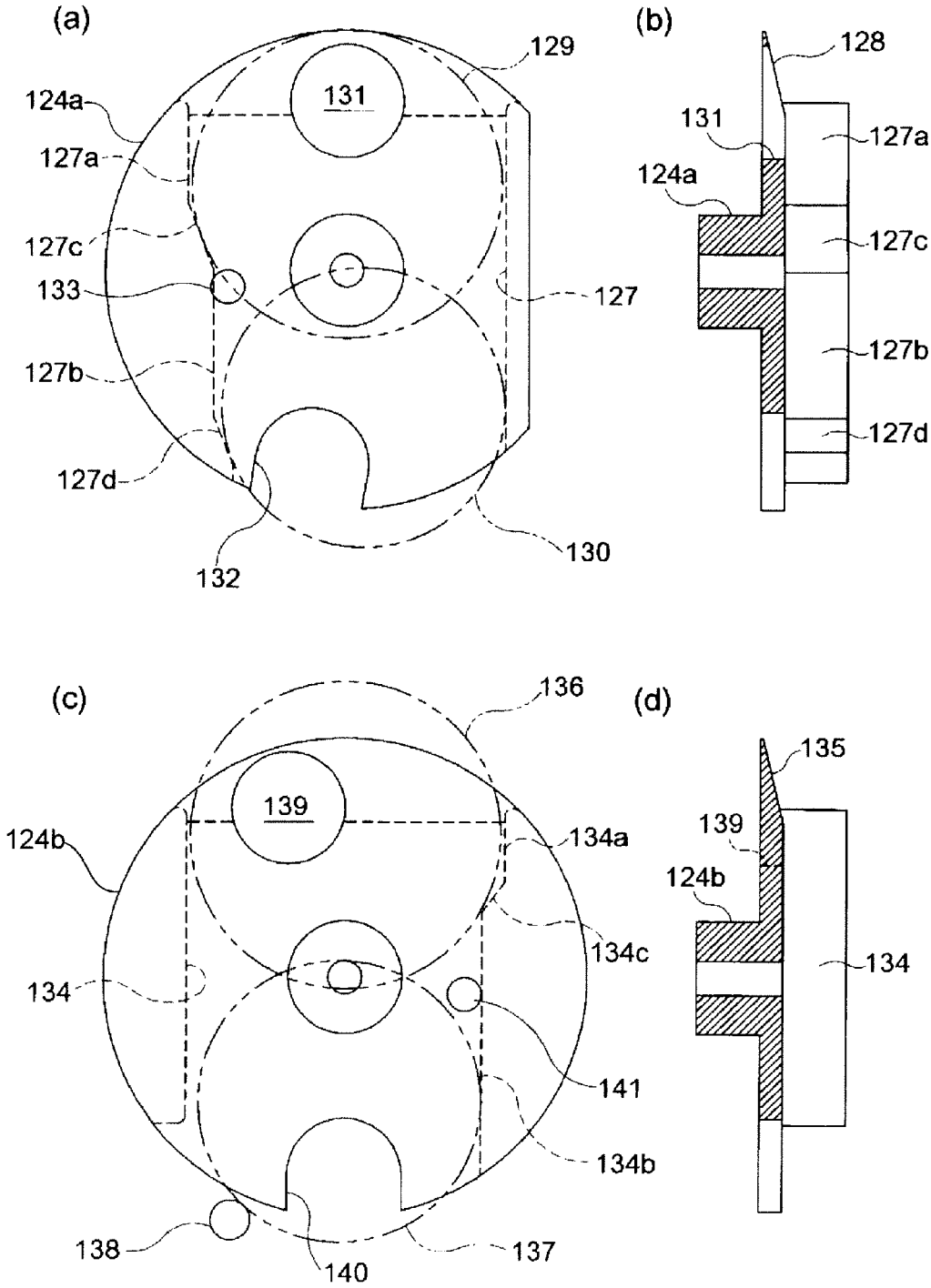
FIG. 12 is a front view (a) and a cross-sectional view (b) of a large cap rotor, as well as a front view (c) and a cross-sectional view (d) of a small cap rotor.

The large cap rotor 124*a* and the small cap rotor 124*b* are placed at left and right sides, respectively, between the chute 123 and the substrate 125. They are configured to be rotated by a motor 126 provided in the substrate 125. As illustrated in FIGS. 12(*a*)-12(*b*), the large cap rotor 124*a* has a cutout circular plate shape having a groove 127 in a rear surface. The groove 127 includes a wide width portion 127*a* capable of passing the large cap 3*a* in an upper portion of the drawing, a narrow width portion 127*b* capable of passing not the large cap 3*a* but rather the small cap 3*b* in a lower direction of the wide width portion 127*a*, a first tilt portion 127*c* between the wide width portion 127*a* and the narrow width portion 127*b*, and a second tilt portion 127*d* in a lower direction of the narrow width portion 127*b*. A taper surface 128 is formed at an edge of an inlet of the wide width portion 127*a* so that the wide width portion 127*a* may easily receive the cap 3*a*. A large cap receiving section 129 (hereinafter, OK large cap receiving section) capable of receiving the large cap 3*a*, which should be originally received, is formed by the wide width portion 127*a* and first tilt portion 127*c* of the groove 127 and the chute 123. A small cap receiving section 130 (hereinafter, NG small cap receiving section) capable of receiving the small cap 3*b*, which should not be originally received, is formed by the narrow width portion 127*b*, the second tilt portion 127*b* and the chute 123. In the large cap rotor 124*a*, a through hole 131 is formed in the OK large cap receiving section 129 and a cutout 132 is formed in the NG small cap receiving section 130. Further, a magnet 133 is embedded at an eccentric position of the large cap rotor 124*a*.

As illustrated in FIGS. 12(*c*)-12(*d*), the small cap rotor 124*b* has a circular plate shape having a groove 134 in a rear surface similar to the large cap rotor 124*a*. The groove 134 includes a wide width portion 134*a* capable of passing the large cap 3*a* in an upper portion of the drawing, and a narrow width portion 134*b* capable of passing not the large cap 3*a* but rather the small cap 3*b* in a lower direction of the wide width portion 134*a*. A tilt portion 134*c* is formed between the wide width portion 134*a* and the narrow width portion 134*b*. Further, a taper surface 135 is formed at an edge of an inlet of the wide width portion 134*a* such that the wide width portion 134*a* may easily receive the cap 3*b*. A large cap receiving section 136 (hereinafter, NG large cap receiving section) capable of receiving the big cap 3*a*, which should not be originally received, is formed by the wide width portion 134*a* and first tilt portion 127*c* of the groove 134 and the chute 123. A small cap receiving section 137 (hereinafter, OK small cap receiving section) capable of receiving the small cap 3*b*, which should be originally received, is formed by the narrow width portion 134*b*, the chute 123 and a stopper 138 protruded from the chute 123. In the small cap rotor 124*b*, a through hole 139 is formed in the NG large cap receiving section 136 and a cutout 140 is formed in the OK small cap receiving section 137. Further, a magnet 141 is embedded at an eccentric position of the small cap rotor 124*b*.

Figure 13:
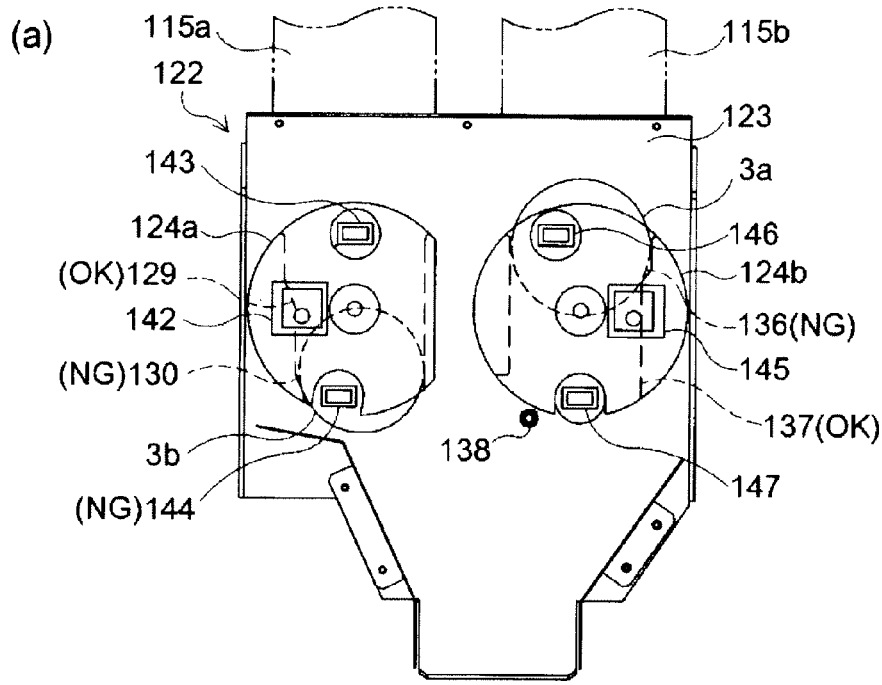
FIG. 13 is a front view showing operations at the time of NG (a) and OK (b) of the cap selecting unit.
Figure 13:
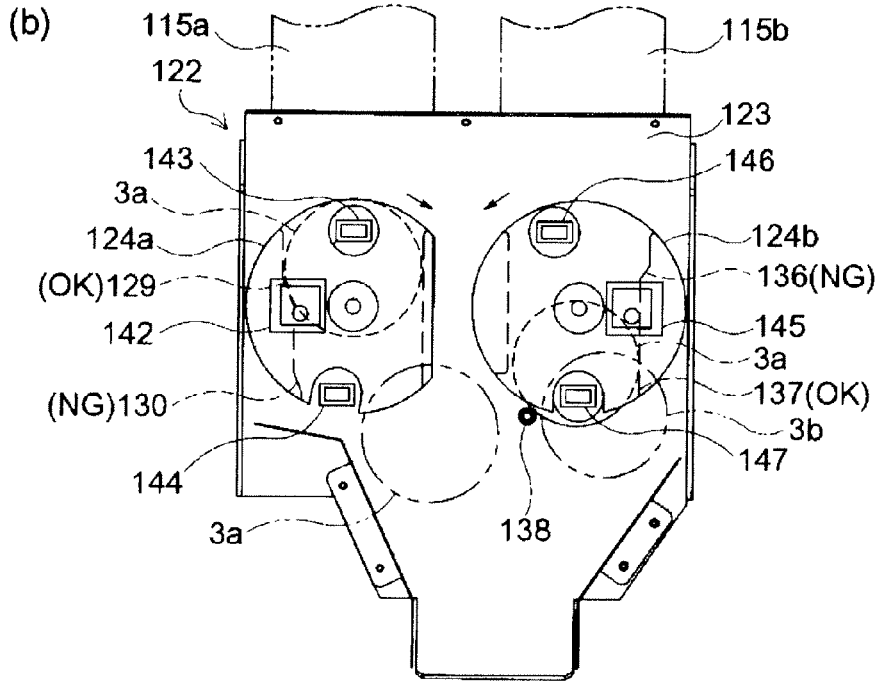

As illustrated in FIGS. 13(*a*)-13(*b*), an origin sensor 142, an OK sensor 143 opposite to the through hole 131 of the OK large cap receiving section 128 and an NG sensor 144 opposite to the cutout 132 of the NG small cap receiving section 130 are provided at a left side portion of the substrate. The origin sensor 142 detects the magnet 133 of the large cap rotor 124*a* when the OK large cap receiving section 129 of the large cap rotor 124*a* faces upward. That is, it is directed to the discharge path 115*a* of the big cap 3*a*. Likewise, an origin sensor 145, an NG sensor 146 opposite to the through hole 139 of the NG large cap receiving section and an OK sensor 147 opposite to the cutout 140 of the OK small cap receiving section 137 are provided at a right side portion of the substrate 125. The origin sensor 145 detects the magnet 141 of the small cap rotor 124*b* when the NG large cap receiving section 136 of the small cap rotor 124*b* faces upward. That is, it is directed to the discharge path 115*b* of the small cap 3*b*.

Figure 14:
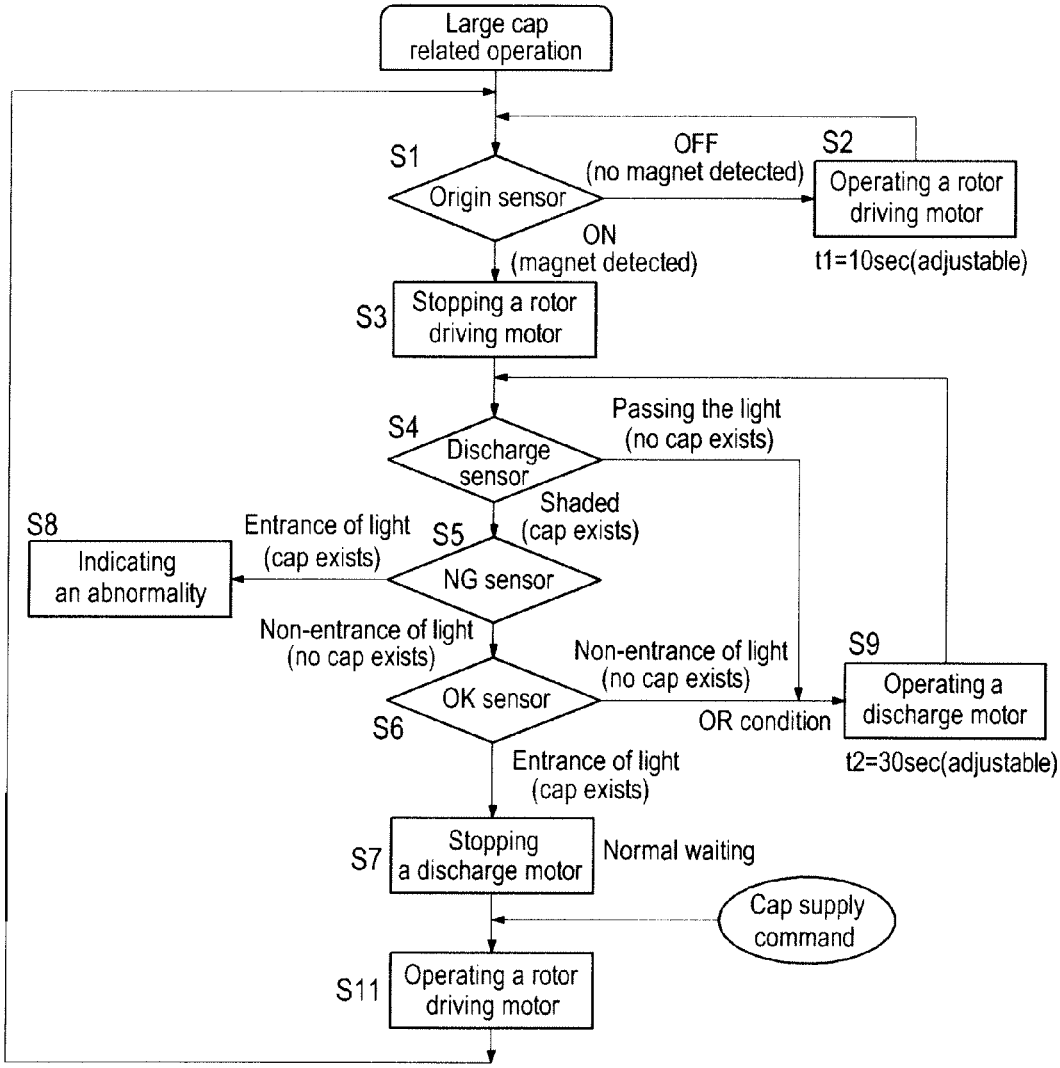
FIG. 14 is a flow chart showing operations of the cap supply unit.

Operations of the cap supply unit 19 as above will be explained according to the flowchart shown in FIG. 14. Following explanations are directed to the large cap 3*a* as well as the small cap 3*b*.

First, in Step S1, it is determined whether the origin sensor 142 of the cap selecting unit 122 is switched ON or OFF. If it is switched OFF, then the rotor driving motor 126 is operated in Step S2. If the origin sensor 142 is switched ON, then the rotor driving motor 126 is stopped in Step S3. In Step S4, if the discharge sensor 114 of the cap supply unit 19 is shaded by a passing of the caps 3, then it is noted that there is the cap 3*a* in the discharge path 115*a*. Thus, in Step S5 it is determined whether there is the cap 3*a* in the NG small cap receiving section 130 according to whether the NG sensor 144 detects an entrance of light. If the discharge sensor 114 of the cap discharge unit 19 passes the light in Step S4, since there is no cap 3*a* in the discharge path 115*a*, the discharge motor 111 is operated in Step S9 and the process returns to Step S4 and waits until the cap 3*a* is discharged.

If it is determined in Step S5 that there is no small cap 3*b* in the NG small cap receiving section 130, since the large cap 3*a* is received to rotate the large cap rotor 124*a*, only the large cap 3*a* can be supplied. Thus, if it is determined in Step S6 that since the OK sensor 143 detects the entrance of light, there is the large cap 3*a* in the OK large cap receiving section 129, the discharge motor 111 is stopped in Step S7 and the process waits for a cap supply command. Further, if it is determined that since the OK sensor 143 does not detect the entrance of light, there is no large cap 3*a* in the OK large cap receiving section 129, the discharge motor 111 is operated in Step S9 and the process returns to Step S4 and repeats the above steps until the large cap 3*a* is received in the OK large cap receiving section 129.

In Step S5, if it is determined that there is the small cap 3*b* in the NG small cap receiving section 130, since the large cap 3*a* is received to rotate the large cap rotor 124*a*, the large and small caps 3*a* and 3*b* are discharged. Thus, an abnormality is indicated in Step S8.

After Step S7, if the cap supply command is instructed, then the rotor driving motor 126 is operated in Step S11 to thereby rotate the large cap rotor 124*a* in a clockwise direction of the drawing by about 180°. By doing so, as indicated with a two-dot chain line, the large cap 3*a* can be supplied to the capping unit 20.

<Capping Unit>

Figure 15:
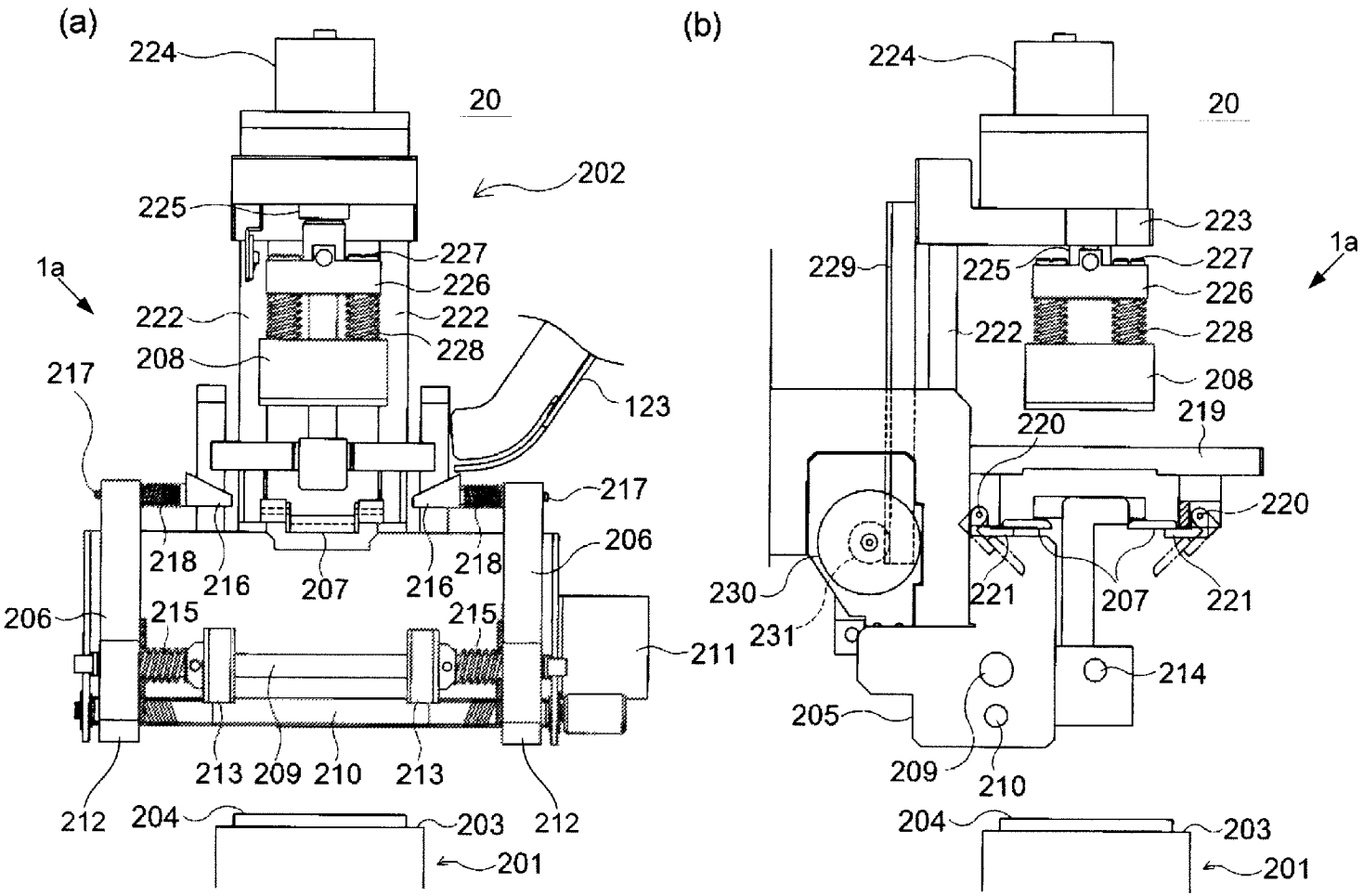
FIG. 15 is a front view (a) and a side view (b) of a capping unit.

FIGS. 15(*a*) and 15(*b*) respectively show a front view and a side view of the capping unit 20. The capping unit 20 includes a vial lift device 201 and a capping body 202.

The vial lift device 201 has a trap 203 where the vials 4 are stacked on. The trap 203 can be lifted between a downward position for delivering the vials 4 within the second vial delivery arm unit 18 and an upward position for delivering the vials 4 within the capping body 202. A rubber mat 204 for anti-skid is provided in the trap 103.

The capping body 202 is provided in a lower direction of the cap supply unit 19. The capping body 202 includes a base structure 205 fixed at a device body 1*a* provided with a pair of vial hold arms 206, a pair of cap support levers 207 and a capping rotor 208.

The vial hold arm 206 comprises a pair of arm bodies 212. The arm bodies 212 are supported at a guide axis 209 and a driving axis 210 provided parallel to the base structure 205 and become close to or apart from each other in right and left horizontal directions seen from a front of the capping body 202 through rotating the driving axis 210 by a motor 211. An axis 214 is inserted through a lower portion of the pair of the arm bodies 212. A hold portion 213 for holding the vials 4 is provided, which is capable of being oscillated in a leading end of the axis 214. A coil spring 215 is mounted between the hold portion 213 and the arm body 212 to relieve an impact when the vials 4 are held by the hold portion 213. A pair of axis portions 217 is inserted through an upper portion of the pair of the arm bodies 212. The axis portions 217 are provided with a guide portion 216 for holding to guide the caps 3. A coil spring 218 is also mounted between the guide portion 216 and the arm body 212 to relieve an impact when the caps 4 are held by the guide portion 216.

The cap support lever 207 is provided in a front-rear position when seen from a front of the capping body 202 of a rectangular frame 219. The frame 219 is extended in parallel from the base structure 205. The cap support lever 207 has a support frame 221 for supporting the caps 3 in a leading end thereof. The cap support lever 207 is approximately L-shape when seen from a side direction of the capping body 202 and provided rotatable around an axis 220. The cap support lever 207 can be rotated between a support position and a shelter position. The support position is capable of supporting the caps 3 since the support portion 221 contacts a part of the frame 219 to become horizontal as indicated with a solid line in the drawing. The shelter position is capable of passing the caps 3 since the support portion 221 is tilted as indicated with a two-dot chain line in the drawing. Further, the cap support lever 207 is pressed toward the support position by a spring (not shown). The support position of the cap support lever 207 is positioned at a lower direction in a lower end of the chute 123 of the cap selecting unit 122 and in an approximately same level as a lower surface of the guide portion 216 of the vial hold arm 206 so as to be capable of supporting the caps 3 supplied from the chute 123.

The capping rotor 208 is provided in a base 223 rotatable by a motor 224. The base 223 is inserted though a pair of rods 222 extended upward from the base structure 205. The capping rotor 208 is provided in a lower end of a pair of driving axes 227. The driving axes 227 are inserted through a disc 226 provided in a driving axis 225 of the motor 224 so as to be slidably movable. A spring 228 is mounted on an axis between the disc 226 and the rotor 208 to relieve an impact when the caps 3 are pressed by the rotor 208. Further, a rack 229 is provided in the base 223. Since the rack 229 is engaged with a pinion 231 of a motor provided in the base structure 205, the base 223 is configured to be liftable.

Figure 16:
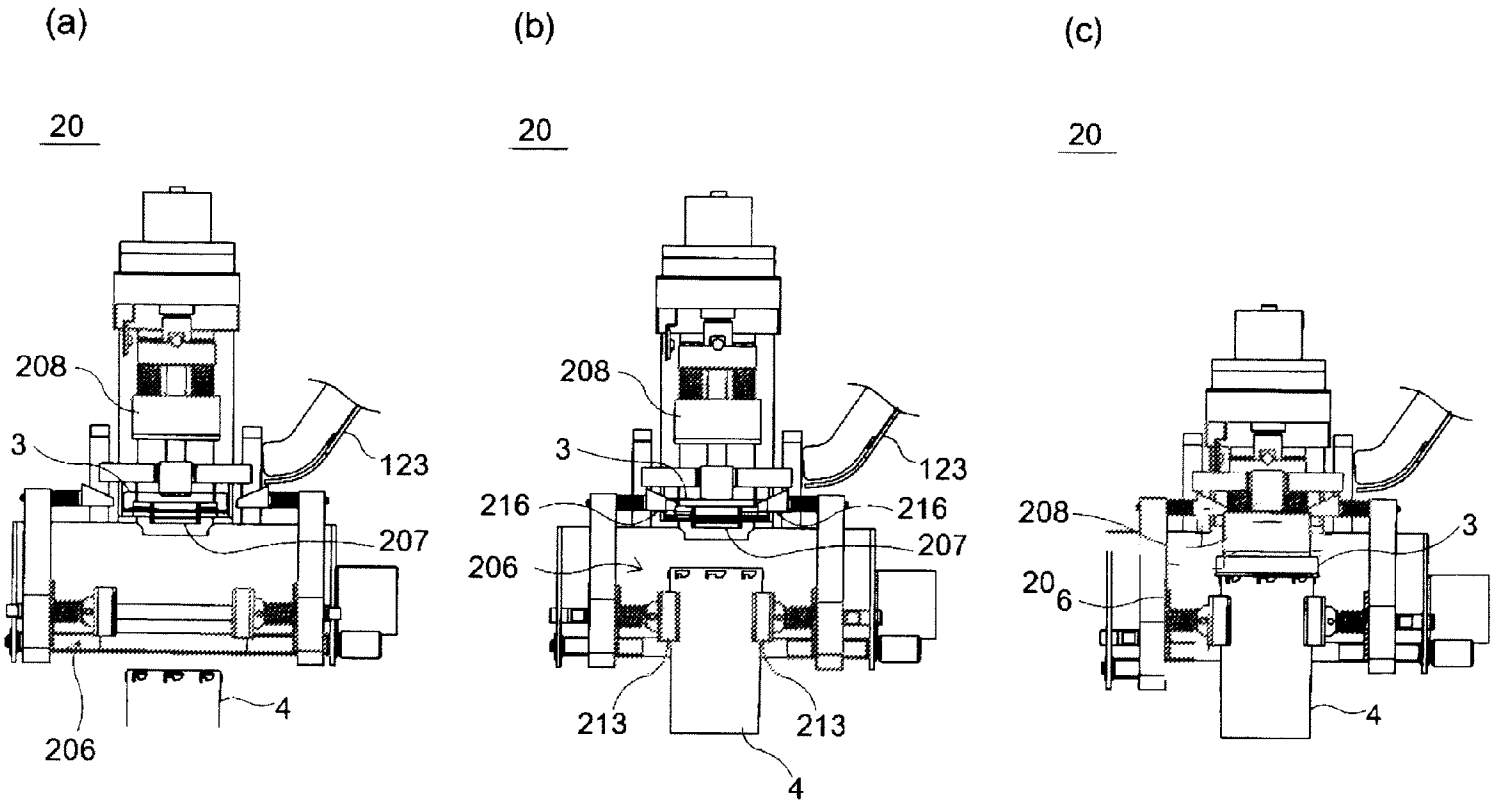
FIG. 16*a, b* and *c* are a front views showing operations of the capping unit.

Operations of the capping device 20 as above will be explained according to FIGS. 16(*a*)-16(*c*). First, as shown in FIG. 16(*a*), the caps 3 are supplied from the chute 123 of the cap selecting unit 122 and supported on the cap support lever 207. The vials 4 filled with tablets are stacked on the trap 203 of the vial lift device 201 by the second vial delivery arm unit 18 to be moved to the upward position. Next, as shown in FIG. 16(*b*), the vial hold arm 206 is operated to hold the vials 4 by the hold portion 213 and the caps 3 by the guide portion 216. Then, as shown in FIG. 16(*c*), the capping rotor 208 is lowered to press the caps 3 toward the vials 4. At this time, since the cap support lever 207 shelters to the shelter position against a pressing force, the caps 3 are guided to the hold portion 213 and passed through the cap support lever 207 to thereby be pressed to the vials 4. Here, since the capping rotor 208 is rotated, the caps 3 are coupled with the vials 4. If the capping is finished, then the rotor is lifted and returned to an original position. Further, since the cap support lever 207 at the shelter position contacts the capping rotor 208, if the capping rotor 208 is lifted, then the cap support lever 207 is returned to the support position. Finally, the vial hold arm 206 is operated to be returned to the shelter position. As such, the capped vials 4 are returned to the downward position by lowering the vial lift device 201 and guided to the second vial delivery arm unit 18.

Although various embodiments of the present invention are described above, it will be evident to one skilled in the art that various changes and modifications may be made without departing from the invention. It is intended in the appended claims to cover all such changes and modifications that fall within the true spirit and scope of the invention.

What is claimed is:

1. A cap supply device for receiving caps configured to close vials filled with tablets and supplying the caps to a capping section one at a time, the cap having a center of gravity at a side opposite opening of the caps, the cap supply device comprising:

a receiving section for receiving the caps;

a discharge unit having an endless member within the receiving section and support members located at the endless member, the discharge unit being configured to upwardly lift and discharge the caps from the receiving section while the caps are vertically supported in the support members with the openings of the caps being directed to an opposite side of the endless member, wherein the endless member has a vertical portion and a tilt portion inclined downwardly from a lower end of the vertical portion; and a plurality of cap supply devices, wherein the caps are of different types and are discharged from the cap supply devices, each cap supply device having a cap selecting unit for selecting and supplying the caps discharged, wherein a stirring member is provided within a side wall of the receiving section, the stirring member being configured to reciprocate in a vertical direction along the side wall, and wherein the stirring member is driven to interlock with the endless member.

2. The cap supply device of claim 1, wherein a stirring member is provided within a side wall of the receiving section, the stirring member being configured to reciprocate in a vertical direction along the side wall.

3. The cap supply device of claim 2, wherein the cap selecting unit has a cap receiving section for receiving the caps and a plurality of rotary members provided at each of the cap supply devices, wherein the rotary members are rotatable between a receiving position where the cap receiving section is directed opposite to a discharging direction of the caps discharged from each cap supply device and a supplying position where the cap receiving section is directed to a supplying direction of the caps, and wherein the cap selecting unit selects any one of the caps discharged from the cap supply devices by selectively rotating the rotary members.

4. The cap supply device of claim 2, wherein the stirring member is driven to interlock with the endless member.

5. The cap supply device of claim 4, wherein the cap selecting unit has a cap receiving section for receiving the caps and a plurality of rotary members provided at each of the cap supply devices, wherein the rotary members are rotatable between a receiving position where the cap receiving section is directed opposite to a discharging direction of the caps discharged from each cap supply device and a supplying position where the cap receiving section is directed to a supplying direction of the caps, and wherein the cap selecting unit selects any one of the caps discharged from the cap supply devices by selectively rotating the rotary members.

6. The cap supply device of claim 1, wherein the cap selecting unit has a cap receiving section for receiving the caps and a plurality of rotary members provided at each of the cap supply devices, wherein the rotary members are rotatable between a receiving position where the cap receiving section is directed opposite to a discharging direction of the caps discharged from each cap supply device and a supplying position where the cap receiving section is directed to a supplying direction of the caps, and wherein the cap selecting unit selects any one of the caps discharged from the cap supply devices by selectively rotating the rotary members.

7. The cap supply device of claim 1, wherein the cap selecting unit has a cap receiving section for receiving the caps and a plurality of rotary members provided at each of the cap supply devices, wherein the rotary members are rotatable between a receiving position where the cap receiving section is directed opposite to a discharging direction of the caps discharged from each cap supply device and a supplying position where the cap receiving section is directed to a supplying direction of the caps, and wherein the cap selecting unit selects any one of the caps discharged from the cap supply devices by selectively rotating the rotary members.

8. The cap supply device of claim 1, wherein the cap selecting unit has a cap receiving section for receiving the caps and a plurality of rotary members provided at each of the cap supply devices, wherein the rotary members are rotatable between a receiving position where the cap receiving section is directed opposite to a discharging direction of the caps discharged from each cap supply device and a supplying position where the cap receiving section is directed to a supplying direction of the caps, and wherein the cap selecting unit selects any one of the caps discharged from the cap supply devices by selectively rotating the rotary members.

9. A cap supply device for receiving caps configured to close vials filled with tablets and supplying the caps to a capping section one at a time, the cap having a center of gravity at a side opposite opening of the caps, the cap supply device comprising:

a receiving section for receiving the caps; and a discharge unit having an endless member within the receiving section and support members located at the endless member, the discharge unit being configured to upwardly lift and discharge the caps from the receiving section while the caps are vertically supported in the support members with the openings of the caps being directed to an opposite side of the endless member, wherein the endless member has a vertical portion and a tilt portion inclined downwardly from a lower end of the vertical portion, wherein a stirring member is provided within a side wall of the receiving section, the stirring member being configured to reciprocate in a vertical direction along the side wall, and wherein the stirring member is formed from a plate parallel to the side wall of the receiving section, the stirring member being provided with a hanging section for hanging the caps.

10. The cap supply device of claim 9, wherein the hanging section includes a hole extended in a horizontal direction, and wherein a plurality of holes is formed in a vertical direction at regular intervals.

11. The cap supply device of claim 10, wherein the stirring member is driven to interlock with the endless member.

12. The cap supply device of claim 11, further comprising a plurality of cap supply devices, wherein the caps are of different types and are discharged from the cap supply devices, each cap supply device having a cap selecting unit for selecting and supplying the caps discharged.

13. The cap supply device of claim 12, wherein the cap selecting unit has a cap receiving section for receiving the caps and a plurality of rotary members provided at each of the cap supply devices, wherein the rotary members are rotatable between a receiving position where the cap receiving section is directed opposite to a discharging direction of the caps discharged from each cap supply device and a supplying position where the cap receiving section is directed to a supplying direction of the caps, and wherein the cap selecting unit selects any one of the caps discharged from the cap supply devices by selectively rotating the rotary members.

14. The cap supply device of claim 10, further comprising a plurality of cap supply devices, wherein the caps are of different types and are discharged from the cap supply devices, each cap supply device having a cap selecting unit for selecting and supplying the caps discharged.

15. The cap supply device of claim 14, wherein the cap selecting unit has a cap receiving section for receiving the caps and a plurality of rotary members provided at each of the cap supply devices, wherein the rotary members are rotatable between a receiving position where the cap receiving section is directed opposite to a discharging direction of the caps discharged from each cap supply device and a supplying position where the cap receiving section is directed to a supplying direction of the caps, and wherein the cap selecting unit selects any one of the caps discharged from the cap supply devices by selectively rotating the rotary members.

16. The cap supply device of claim 9, wherein the stirring member is driven to interlock with the endless member.

17. The cap supply device of claim 16, further comprising a plurality of cap supply devices, wherein the caps are of different types and are discharged from the cap supply devices, each cap supply device having a cap selecting unit for selecting and supplying the caps discharged.

18. A cap supply device for receiving caps configured to close vials filled with tablets and supplying the caps to a capping section one at a time, the cap having a center of gravity at a side opposite opening of the caps, the cap supply device comprising:

a receiving section for receiving the caps;

a discharge unit having an endless member within the receiving section and support members located at the endless member, the discharge unit being configured to upwardly lift and discharge the caps from the receiving section while the caps are vertically supported in the support members with the openings of the caps being directed to an opposite side of the endless member, wherein the endless member has a vertical portion and a tilt portion inclined downwardly from a lower end of the vertical portion; and a plurality of cap supply devices, wherein the caps are of different types and are discharged from the cap supply devices, each cap supply device having a cap selecting unit for selecting and supplying the caps discharged, wherein the cap selecting unit has a cap receiving section for receiving the caps and a plurality of rotary members provided at each of the cap supply devices, wherein the rotary members are rotatable between a receiving position where the cap receiving section is directed opposite to a discharging direction of the caps discharged from each cap supply device and a supplying position where the cap receiving section is directed to a supplying direction of the caps, and wherein the cap selecting unit selects any one of the caps discharged from the cap supply devices by selectively rotating the rotary members.

* * * * *